US008030859B2

(12) United States Patent
Takata

(10) Patent No.: US 8,030,859 B2
(45) **Date of Patent: *Oct. 4, 2011**

(54) COLD-CATHODE LAMP, AND DISPLAY ILLUMINATION DEVICE AND DISPLAY DEVICE THEREWITH

(75) Inventor: Yoshiki Takata, Suzuka (JP)

(73) Assignee: Sharp Kabushiki Kaisha, Osaka (JP)

( * ) Notice: Subject to any disclaimer, the term of this patent is extended or adjusted under 35 U.S.C. 154(b) by 355 days.

This patent is subject to a terminal disclaimer.

(21) Appl. No.: 12/295,311

(22) PCT Filed: Nov. 27, 2006

(86) PCT No.: PCT/JP2006/323550

§ 371 (c)(1),
(2), (4) Date: Sep. 30, 2008

(87) PCT Pub. No.: WO2007/132543

PCT Pub. Date: Nov. 22, 2007

(65) Prior Publication Data

US 2010/0225253 A1 Sep. 9, 2010

(30) Foreign Application Priority Data

May 12, 2006 (JP) ..... 2006-133636

(51) Int. Cl.
*H01J 17/38* (2006.01)
*H05B 41/00* (2006.01)

(52) U.S. Cl. ..... 315/324; 324/326; 324/59; 313/581; 313/594; 313/493

(58) Field of Classification Search ..... 315/324, 315/326, 59; 313/594, 493, 491; 362/97.1, 362/97.2

See application file for complete search history.

(56) References Cited

U.S. PATENT DOCUMENTS 4,912,368 A 3/1990 Nishiyama et al.

(Continued)

FOREIGN PATENT DOCUMENTS

JP 63-098163 A 4/1988

(Continued)

OTHER PUBLICATIONS

Official Communication issued in International Patent Application No. PCT/JP2006/323550, mailed on Dec. 26, 2006.

(Continued)

*Primary Examiner* — Vibol Tan
(74) *Attorney, Agent, or Firm* — Keating & Bennett, LLP

(57) ABSTRACT

A cold cathode lamp includes a light-transmitting insulating tube, first and second internal electrodes arranged inside the insulating tube, first and second external electrodes arranged outside the insulating tube and respectively connected with the first and second internal electrodes, first and second insulating bodies respectively covering the first and second external electrodes, a first counter electrode arranged opposite to the first external electrode via the first insulating body, and a second counter electrode arranged opposite to the second external electrode via the second insulating body. The first (second) counter electrode has a portion which does not face the first (second) external electrode, and the space between this portion and the insulating tube is filled with the first (second) insulating body. A plurality of such cold cathode lamps can be lit by being connected in parallel with a power supply. In addition, generation of corona discharge near the outer peripheries of the counter electrodes can be suppressed.

10 Claims, 12 Drawing Sheets

U.S. PATENT DOCUMENTS

| | | | | |
|---|---|---|---|---|
| 5,387,837 | A | 2/1995 | Roelevink et al. | |
| 5,705,879 | A | 1/1998 | Abe et al. | |
| 5,982,089 | A | 11/1999 | Wesselink et al. | |
| 7,638,945 | B2 * | 12/2009 | Takata | 313/607 |
| 2003/0214478 | A1 | 11/2003 | Yoo et al. | |
| 2004/0239260 | A1 | 12/2004 | Nakano | |
| 2006/0001386 | A1 * | 1/2006 | Kim et al. | 315/312 |
| 2006/0197424 | A1 | 9/2006 | Takata | |
| 2009/0096958 | A1 * | 4/2009 | Matsuura et al. | 349/70 |
| 2010/0084977 | A1 * | 4/2010 | Iwamoto | 315/59 |
| 2010/0109544 | A1 * | 5/2010 | Hayashi | 315/246 |
| 2010/0220462 | A1 * | 9/2010 | Nakanishi et al. | 362/97.2 |
| 2010/0225254 | A1 * | 9/2010 | Takata | 315/324 |

FOREIGN PATENT DOCUMENTS

| | | | |
|---|---|---|---|
| JP | 02-041362 | U | 3/1990 |
| JP | 02-057539 | U | 4/1990 |
| JP | 03-261067 | A | 11/1991 |
| JP | 05-121049 | A | 5/1993 |
| JP | 05-275060 | A | 10/1993 |
| JP | 09-017329 | A | 1/1997 |
| JP | 11-040109 | A | 2/1999 |
| JP | 2003-257377 | A | 9/2003 |
| JP | 2004-039264 | A | 2/2004 |
| JP | 2004-039336 | A | 2/2004 |

OTHER PUBLICATIONS

Takata: "Cold Cathode Lamp, and Display Illumination Device for Display Device and Display Device Provided Therewith," U.S. Appl. No. 12/295,324, filed Sep. 30, 2008.

Takata: "Illumination Device for Display Device and Display Device Provided Therewith," U.S. Appl. No. 12/295,384, filed Sep. 30, 2008.

Takata: "Illuminating Apparatus for Display Device and Display Device Having Same," U.S. Appl. No. 12/296,453, filed Oct. 8, 2008.

Takata: "Holding Member, Illumination Device for Display Device Having the Holding Member, and Display Device Having the Holding Member," U.S. Appl. No. 12/300,652, filed Nov. 13, 2008.

* cited by examiner

COLD-CATHODE LAMP, AND DISPLAY ILLUMINATION DEVICE AND DISPLAY DEVICE THEREWITH

BACKGROUND OF THE INVENTION

1. Field of the Invention

The present invention relates to a cold cathode lamp.

2. Description of the Related Art

A schematic sectional view of a conventional cold-cathode lamp is shown in FIG. 14. The conventional cold-cathode lamp shown in FIG. 14 has internal electrodes 2 and 3 inside a glass tube 1. Part of each of the internal electrodes 2 and 3 leads out of the glass tube 1 through its wall to function as an electrode terminal. In this structure, the interior of the glass tube 1 is air-tight. The interior wall surface of the glass tube 1 is coated with a fluorescent material. Inside the air-tight glass tube 1 are typically sealed neon and argon in a ratio of 95:5 or 80:20, for instance, such that the overall pressure inside the glass tube 1 is in the range of $10.7\times10^3$ to $5.3\times10^3$ Pa (≈80 to 40 Torr) along with several milligrams of mercury. Instead of mercury, xenon may be sealed in.

When the lamp voltage (the voltage between the internal electrodes) reaches the discharge start voltage $V_S$, electric discharge starts. The electric discharge causes the mercury or xenon to generate ultraviolet rays, which cause the fluorescent material coating the inner wall surface of the glass tube 1 to glow.

In terms of its equivalent circuit, the conventional cold-cathode lamp shown in FIG. 14 acts as a resistor whose resistance decreases nonlinearly as the current through it increases, and exhibits a nonlinear negative impedance characteristic, like the V-I characteristic shown in FIG. 15 (see, for example, Patent Document 3 listed below).

One use of the conventional cold-cathode lamp shown in FIG. 14 is as a backlight in a liquid crystal display device. For a liquid crystal display device with a large display screen, a plurality of cold-cathode lamps are used arranged side by side. In this case, if all the cold-cathode lamps can be driven in parallel, they can all be fed with an equal voltage, requiring a single power supply.

Now we will consider parallel driving of a plurality of (for example, three) cold-cathode lamps. The V-I characteristic of the cold-cathode lamp varies from one individual to another, a first to a third cold-cathode lamp exhibiting different V-I characteristics as represented by the V-I characteristic curves T1 to T3 in FIG. 16. The first to third cold-cathode lamps are fed with an equal alternating-current voltage, which is then raised. When the alternating-current voltage has risen to reach the discharge start voltage $V_{S1}$ of the first cold-cathode lamp, it is lit; thereafter the nonlinear negative impedance characteristic of the first cold-cathode lamp causes the voltage across it to fall. Since the voltage across the second and third cold-cathode lamps equals that across the first, the alternating-current voltage never reaches the discharge start voltages $V_{S2}$ and $V_{S3}$ of the second and third cold-cathode lamps. Thus, when a plurality of cold-cathode lamps are simply driven in parallel, only one of them can be lit. This is the reason that, generally, a plurality of power supply circuits are provided one for each of a plurality of cold-cathode lamps to light them all. Inconveniently, however, not only does this configuration require as many power supply circuits as there are cold-cathode lamps, incurring accordingly high costs, but it also thwarts size reduction, weight reduction, and cost reduction. On the other hand, generally, the cold-cathode lamps are connected to their respective power supply circuits via harnesses (also called leads) and connectors. This makes the fitting of cold-cathode lamps troublesome, resulting in low efficiency of the assembly of illumination devices and the like employing cold-cathode lamps, and also makes the removal of cold-cathode lamps troublesome, resulting in low efficiency of the replacement of cold-cathode lamps, and of the disassembly of illumination devices and the like employing cold-cathode lamps.

As a solution to the inconveniences mentioned above, there have been developed external-electrode fluorescent lamps (see, for example, Patent Documents 1 and 2 listed below). A schematic sectional view of an external-electrode fluorescent lamp is shown in FIG. 17. In FIG. 17, such parts as find their counterparts in FIG. 14 are identified by common reference signs and their detailed description will not be repeated. In the external-electrode fluorescent lamp shown in FIG. 17, as compared with the conventional cold-cathode lamp shown in FIG. 14, the internal electrodes 2 and 3 are omitted, and instead external electrodes 4 and 5 are formed one at each end of the glass tube 1. In this structure, the interior of the glass tube 1 is air-tight.

In the external-electrode fluorescent lamp shown in FIG. 17, when the lamp voltage (the voltage between the external electrodes) reaches the discharge start voltage $V_S'$, electric discharge starts. The electric discharge causes the mercury or xenon to generate ultraviolet rays, which cause the fluorescent material coating the inner wall surface of the glass tube 1 to glow.

The interior of the glass tube 1 has a nonlinear negative impedance characteristic, and is insulated by the glass from the external electrodes 4 and 5. Thus, in terms of its equivalent circuit, the external-electrode fluorescent lamp shown in FIG. 17 acts as a serial circuit composed of a resistor whose resistance decreases nonlinearly as the current through it increases and capacitors connected one to each terminal of the resistor. Accordingly, the external-electrode fluorescent lamp shown in FIG. 17 as a whole exhibits a nonlinear positive impedance characteristic, like the V-I characteristic shown in FIG. 18.

Now we will consider parallel driving of a plurality of (for example, three) external-electrode fluorescent lamps. The V-I characteristic of the external-electrode fluorescent lamp varies from one individual to another, a first to a third external-electrode fluorescent lamps exhibiting different V-I characteristics as represented by the V-I characteristic curves T1' to T3' in FIG. 19. The first to third external-electrode fluorescent lamps are fed with an equal alternating-current voltage, which is then raised. When the alternating-current voltage has risen to reach the discharge start voltage $V_{S1}'$ of the first external-electrode fluorescent lamp, it is lit. Thereafter, as the output of the power supply increases, the alternating-current voltage rises. When the alternating-current voltage reaches the discharge start voltage $V_{S2}'$ of the second external-electrode fluorescent lamp, it is lit and, when the alternating-current voltage reaches the discharge start voltage $V_{S3}'$ of the third external-electrode fluorescent lamp, it is lit. Thus, when a plurality of external-electrode fluorescent lamps are simply driven in parallel, they can all be lit.

On the other hand, thanks to the external electrodes provided on the exterior surface of the glass tube, in illumination devices and the like employing external-electrode fluorescent lamps, these can be held by the resilience of holding members formed of a resilient metal material (for example, spring steel), with the holding members pinching in them the external electrodes of the external-electrode fluorescent lamps. This permits the external-electrode fluorescent lamps to be supplied with electric power via the holding members. Conveniently, this structure makes the fitting and removal of external-electrode fluorescent lamps easy.

Patent Document 1: JP-A-2004-31338
Patent Document 2: JP-A-2004-39264
Patent Document 3: JP-A-H7-220888 (FIG. 4)
Patent Document 4: JP-A-2004-39336
Patent Document 5: JP-A-H5-121049
Patent Document 6: JP-A-S64-82452
Patent Document 7: JP-A-2003-100482
Patent Document 8: JP-A-H11-40109
Patent Document 9: JP-U-H2-41362
Patent Document 10: JP-A-H6-84499

Inconveniently, however, in an external-electrode fluorescent lamp, since the glass between the external electrodes and the interior space of the glass tube acts as the dielectric between the electrodes of the capacitor as one component of the equivalent circuit of the external-electrode fluorescent lamp, charged particles collide with the part of the inner wall surface of the glass tube facing away from the external electrodes, wearing (sputtering) off the inner wall surface of the glass tube locally. As the inner wall surface of the glass tube wears off, the capacitance of its worn part grows, causing charged particles collide with that part in an increasingly concentrated fashion, eventually forming pinholes and making it impossible to keep the interior of the glass tube air-tight. Thus external-electrode fluorescent lamps are unsatisfactorily reliable.

SUMMARY OF THE INVENTION

To overcome the inconveniences and problems discussed above, preferred embodiments of the present invention provide a cold-cathode lamp that can be lit in parallel by being driven in parallel and that in addition offers high reliability, and provide a display illumination device (an illumination device for a display device) and a display device incorporating such a cold-cathode According to a preferred embodiment of the present invention, a cold-cathode lamp that, when mounted for actual use, is supplied with electric power via first and second conductive members provided externally includes: an insulating tube formed of a light-transmitting (so long as enough light is transmitted to enable the lamp to function as such, light may be partly shielded or may be partly or completely attenuated), electrically insulating material; a first internal electrode disposed inside the insulating tube; a second internal electrode disposed inside the insulating tube; a first external electrode disposed outside the insulating tube and connected to the first internal electrode so as to be at the same potential as the first internal electrode; a first insulating member; a first counter electrode disposed to face the first external electrode across the first insulating member. Here, the first counter electrode has a non-facing portion not facing the first external electrode. Moreover, the gap between the non-facing portion of the first counter electrode and the insulating tube is filled by part of the first insulating member. Furthermore, when the cold-cathode lamp is mounted for actual use, the first conductive member and the first counter electrode are electrically connected together. (This structure will hereinafter be referred to as the first structure.) The insulating tube formed of a light-transmitting, electrically insulating material is, for example, a glass tube, a resin tube, or the like. The internal and external electrodes are connected together, for example, with part of the internal electrode leading out of the insulating tube through its wall and connecting to the external electrode, or with part of the external electrode leading into the insulating tube through its wall and connecting to the internal electrode, or with a conductive member penetrating the wall of the insulating tube and leading into and out of it, connecting to the internal and external electrodes. In any of these cases, the interior of the insulating tube is air-tight.

With this, first, structure, the cold-cathode lamp acts, in terms of its equivalent circuit, as a serial circuit including a resistor whose resistance decreases nonlinearly as the current through it increases and a capacitor (hereinafter also referred to as a ballast capacitor) connected to at least one of the terminals of the resistor, exhibiting a nonlinear positive impedance characteristic. This permits a plurality of cold-cathode lamps of the first structure to be lit in parallel. Moreover, the first counter electrode remains in a fixed position relative to the first external electrode. This stabilizes the capacitor formed by the first external electrode and the first counter electrode. Furthermore, the first counter electrode has a non-facing portion not facing the first external electrode, and the gap between the non-facing portion of the first counter electrode and the insulating tube is filled by part of the first insulating member. This prevents corona discharge near the non-facing portion of the first counter electrode, and thus suppresses corona discharge near the edge of the first counter electrode, leading to higher reliability of the cold-cathode lamp.

The cold-cathode lamp of the first structure described above may further include: a second external electrode disposed outside the insulating tube and connected to the second internal electrode so as to be at the same potential as the second internal electrode; a second insulating member; a second counter electrode disposed to face the second external electrode across the second insulating member. Here, the second counter electrode has a non-facing portion not facing the second external electrode. Moreover, the gap between the non-facing portion of the second counter electrode and the insulating tube is filled by part of the second insulating member. Furthermore, when the cold-cathode lamp is mounted for actual use, the second conductive member and the second counter electrode are electrically connected together. (This structure will hereinafter be referred to as the second structure.)

With this, second, structure, the cold-cathode lamp acts, in terms of its equivalent circuit, as a serial circuit including a resistor whose resistance decreases nonlinearly as the current through it increases and capacitors (hereinafter also referred to as ballast capacitors) connected one to each terminal of the resistor, exhibiting a nonlinear positive impedance characteristic. This permits a plurality of cold-cathode lamps of the second structure to be lit in parallel. Moreover, the first counter electrode remains in a fixed position relative to the first external electrode, and the second counter electrode remains in a fixed position relative to the second external electrode. This stabilizes the capacitor formed by the first external electrode and the first counter electrode and the capacitor formed by the second external electrode and the second counter electrode. Furthermore, the first counter electrode has a non-facing portion not facing the first external electrode, and the gap between the non-facing portion of the first counter electrode and the insulating tube is filled by part of the first insulating member; likewise, the second counter electrode has a non-facing portion not facing the second external electrode, and the gap between the non-facing portion of the second counter electrode and the insulating tube is filled by part of the second insulating member. This prevents corona discharge near the non-facing portions of the first and second counter electrodes, and thus suppresses corona discharge near the edges of the first and second counter electrodes, leading to higher reliability of the cold-cathode lamp.

In the cold-cathode lamp of the first structure described above, the first external electrode may not have a non-facing portion not facing the first counter electrode. (This structure will hereinafter be referred to as the third structure.)

With this structure, the first counter electrode has no edge corresponding to the border between the non-facing and facing portions of the first external electrode. This surely prevents corona discharge that may occur near the edge of the first counter electrode corresponding to the border between the non-facing and facing portions of the first external electrode. It is thus possible to further suppress corona discharge near the edge of the first counter electrode, leading to even higher reliability of the cold-cathode lamp.

In the cold-cathode lamp of the second structure described above, the first external electrode may not have a non-facing portion not facing the first counter electrode, and the second external electrode may not have a non-facing portion not facing the second counter With this structure, the first counter electrode has no edge corresponding to the border between the non-facing and facing portions of the first external electrode, and the second counter electrode has no edge corresponding to the border between the non-facing and facing portions of the second external electrode. This surely prevents corona discharge that may occur near the edge of the first counter electrode corresponding to the border between the non-facing and facing portions of the first external electrode and near the edge of the second counter electrode corresponding to the border between the non-facing and facing portions of the second external electrode. It is thus possible to further suppress corona discharge near the edges of the first and second counter electrodes, leading to even higher reliability of the cold-cathode lamp.

In the cold-cathode lamp of the first or third structure described above, the first counter electrode may have a projection, and, when the cold-cathode lamp is mounted for actual use, the first conductive member and the projection of the first counter electrode may make contact with each other. (This structure will hereinafter be referred to as the fifth structure.)

This structure ensures that, in the actually mounted state, the first conductive member and the first counter electrode are electrically connected together.

In the cold-cathode lamp of the second or fourth structure described above, the first counter electrode may have a projection, and, when the cold-cathode lamp is mounted for actual use, the first conductive member and the projection of the first counter electrode may make contact with each other; moreover the second counter electrode may have a projection, and, when the cold-cathode lamp is mounted for actual use, the second conductive member and the projection of the second counter electrode may make contact with each other. (This structure will hereinafter be referred to as the sixth structure.)

This structure ensures that, in the actually mounted state, the first conductive member and the first counter electrode are electrically connected together and the second conductive member and the second counter electrode are electrically connected together.

According to another preferred embodiment of the present invention, a display illumination device includes: the cold-cathode lamp of any one of the first to sixth structures described above; first and second conductive members; and a power supply supplying electric power to the cold-cathode lamp via the first and second conductive members. (This structure will hereinafter be referred to as the seventh structure.)

With this structure, it is possible to drive a plurality of cold-cathode lamps in parallel and light them in parallel, contributing to size reduction, weight reduction, and cost reduction. It is also possible to suppress corona discharge near the edge of the counter electrode of the cold-cathode lamp, contributing to higher reliability.

In the display illumination device of the seventh structure described above, the cold-cathode lamp may include a plurality of like cold-cathode lamps, and all or part of the cold-cathode lamps may be electrically connected in parallel. (This structure will hereinafter be referred to as the eighth structure.)

With this structure, it is possible to reduce the number of power supplies needed, contributing to size reduction, weight reduction, and cost reduction.

In the display illumination device of the eighth structure described above, among the cold-cathode lamps electrically connected in parallel, the phase of the voltage fed to the first internal electrode and the phase of the voltage fed to the second internal electrode may be approximately 180 degrees out of phase with, so as to be inverted with respect to, each other. (This structure will hereinafter be referred to as the ninth structure.)

This structure makes laterally symmetric the brightness slope attributable to the leak current through a conductor (for example, the metal casing of a display illumination device) located near the power lines for parallel connection, contributing to enhanced illumination quality. Moreover, this structure, when the display illumination device described above is incorporated in a display device, makes practically zero the voltage that affects the display device (for example, the display device of a liquid crystal display panel) located near the power lines for parallel connection, making it possible to cancel the noise in the display device originating from the display illumination device.

According to yet another preferred embodiment of the present invention, a display device includes the display illumination device of any one of the seventh to ninth structures described above.

With this structure, it is possible to drive a plurality of cold-cathode lamps in parallel and light them in parallel, contributing to size reduction, weight reduction, and cost reduction. It is also possible to suppress corona discharge near the edge of the counter electrode of the cold-cathode lamp, contributing to higher reliability.

According to various preferred embodiments of the present invention, a cold-cathode lamp acts, in terms of its equivalent circuit, as a serial circuit including a resistor whose resistance decreases nonlinearly as the current through it increases and a capacitor connected to at least one of the terminals of the resistor, exhibiting a nonlinear positive impedance characteristic. This makes it possible to drive a plurality of cold-cathode lamps in parallel and light them in parallel. Moreover, according to preferred embodiments of the present invention, it is possible suppress corona discharge near the edge of the counter electrode of the cold-cathode lamp, contributing to higher reliability.

Other features, elements, steps, characteristics and advantages of the present invention will become more apparent from the following detailed description of preferred embodiments of the present invention with reference to the attached drawings.

DETAILED DESCRIPTION OF THE PREFERRED EMBODIMENTS

Hereinafter, preferred embodiments of the present invention will be described with reference to the accompanying drawings. In a cold-cathode lamp according to a preferred embodiment of the present invention, its internal structure (including what is sealed in) does not involve any feature unique to the present invention, allowing application of various known technologies directed to cold-cathode lamps; in this respect, therefore, no detailed description will be given.

Figure 1:
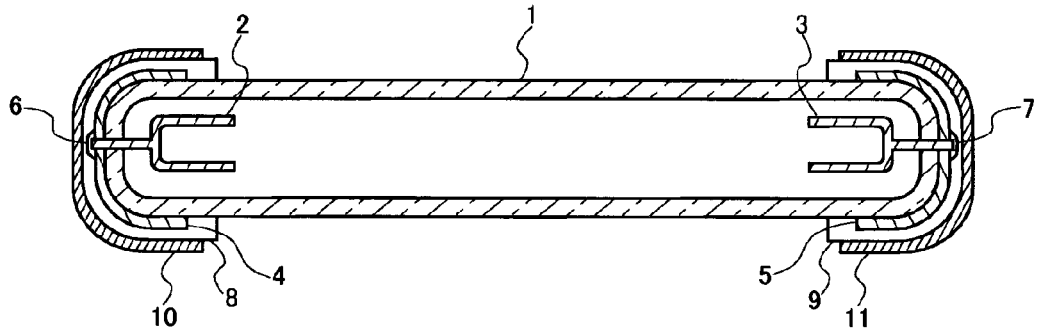
FIG. 1 is a diagram showing a schematic sectional view of a cold-cathode lamp according to a preferred embodiment of the present invention.
Figure 14:
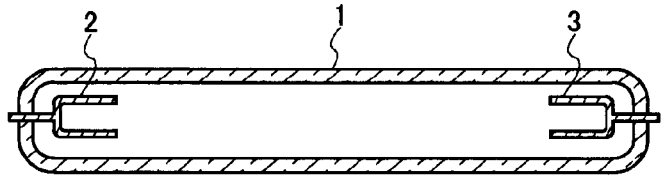
FIG. 14 is a diagram showing a schematic sectional view of a conventional cold-cathode lamp.
Figure 15:
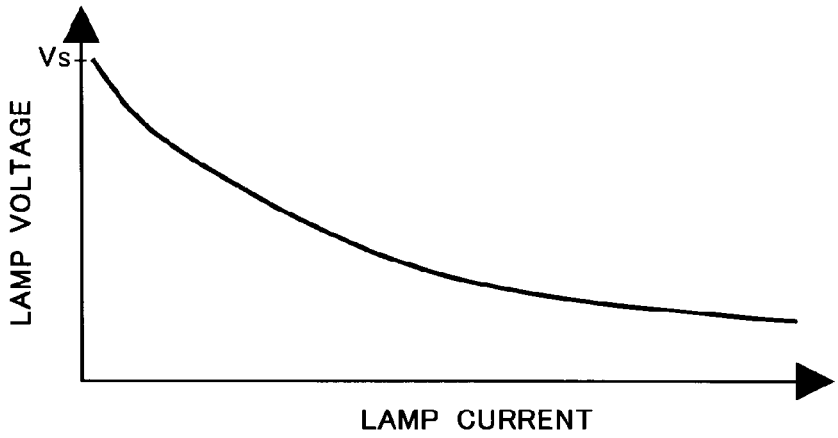
FIG. 15 is a diagram showing the V-I characteristic of the conventional cold-cathode lamp shown in FIG. 14.
Figure 16:
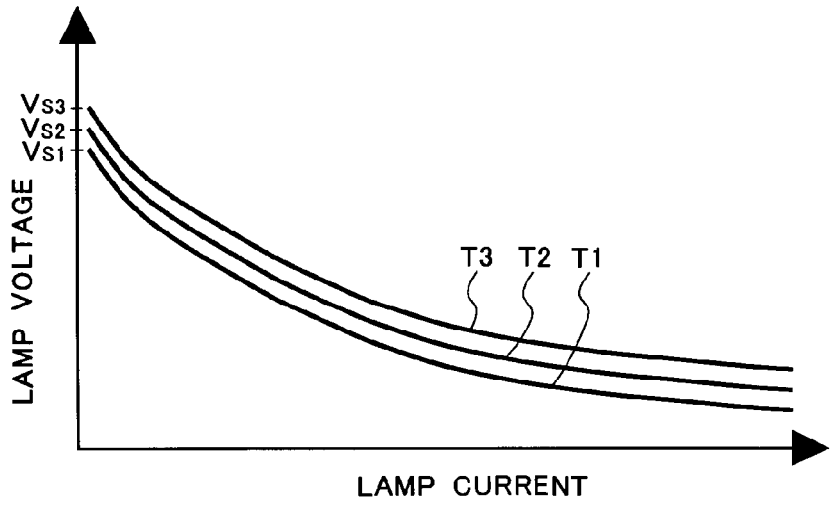
FIG. 16 is a diagram showing the V-I characteristics of a plurality of conventional cold-cathode lamps.

A schematic sectional view of a cold-cathode lamp according to a preferred embodiment of the present invention is shown in FIG. 1. In FIG. 1, such parts as find their counterparts in FIG. 14 are identified by common reference signs and their detailed description will not be repeated. In the cold-cathode lamp shown in FIG. 1, as compared with the conventional cold-cathode lamp shown in FIG. 14, external electrodes 4 and 5 are provided one at each end of the glass tube 1; the lead-out part of the internal electrode 2 and the external electrode 4 are soldered together with solder 6, and the lead-out part of the internal electrodes 3 and the external electrode 5 are soldered together with solder 7; insulating layers 8 and 9 are formed over the external electrodes 4 and 5 respectively; counter electrodes 10 and 11, each in the shape of a cylindrical cap, are formed on the insulating layers 8 and 9 respectively; the counter electrode 10 has a non-facing part not facing the external electrode 4, and the counter electrode 11 has a non-facing part not facing the external electrode 5; the gap between the non-facing portion of the counter electrode 10 and the glass tube 1 is filled by part of the insulating layer 8, and the gap between the non-facing portion of the counter electrode 11 and the glass tube 1 is filled by part of the insulating layer 9; the external electrode 4 does not have a non-facing portion not facing the counter electrode 10, and the external electrode 5 does not have a non-facing portion not facing the counter electrode 11. Specifically, the external electrodes 4 and 5 are formed of, for example, metal paste, metal foil, metal caps, or the like. The insulating layers 8 and 9 are formed of, for example, inorganic ceramic, resin, or the like. So long as satisfactory electrical connection is secured between a projection on the internal electrode 2 and the external electrode 4 and a projection on the internal electrodes 3 and the external electrode 5, the solder 6 and 7 may be omitted.

A display illumination device (an illumination device for a display device) according to a preferred embodiment of the present invention includes the cold-cathode lamp shown in FIG. 1, an illumination unit, and an optical sheet. The cold-cathode lamp shown in FIG. 1 is fitted to holding members provided on the front surface of the illumination unit, and the front surface of the illumination unit, having the cold-cathode lamp shown in FIG. 1 fitted on it, is then covered with the optical sheet.

Figure 2A:
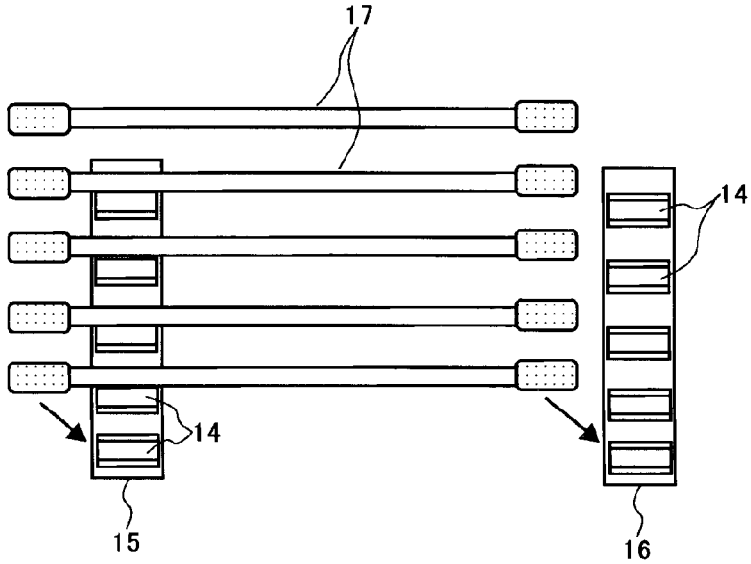
FIG. 2A is a diagram showing how cold-cathode lamps according to a preferred embodiment of the present invention are fitted to holding members.
Figure 2B:
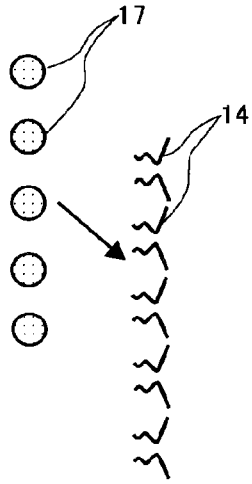
FIG. 2B is a diagram showing how cold-cathode lamps according to a preferred embodiment of the present invention are fitted to holding members.

How the cold-cathode lamp shown in FIG. 1 is fitted to the holding members is shown in FIGS. 2A and 2B, FIG. 2A being a front view and FIG. 2B a side view.

A plurality of pairs of holding members are provided on the front surface of the illumination unit, and one power supply (not illustrated) is provided on the rear surface of the illumination unit. The power supply outputs an alternating-current voltage of several tens of kHz. The holding members 14 provided in a front left-edge portion 15 of the illumination unit are connected together to one end of the power supply. The holding members 14 provided in a front right-edge portion 16 of the illumination unit are connected together to the other end of the power supply. The holding members 14 are formed of a resilient metal material (for example, spring steel), of which the resilience enables the holding members 14 to pinch in them the counter electrodes of the cold-cathode lamp shown in FIG. 1, thereby permitting the counter electrodes 10 and 11 of the cold-cathode lamp 17 structured as shown in FIG. 1 to be electrically connected to the holding members 14. With this structure, it is possible to connect the cold-cathode lamp shown in FIG. 1 and the power supply together without using harnesses (also called leads) and connectors.

Figure 17:
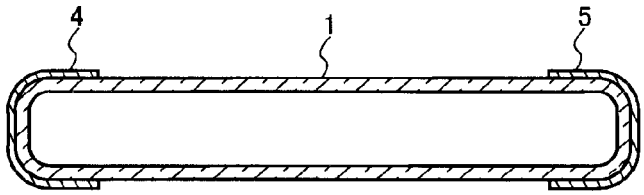
FIG. 17 is a diagram showing a schematic sectional view of a external-electrode fluorescent lamp.
Figure 18:
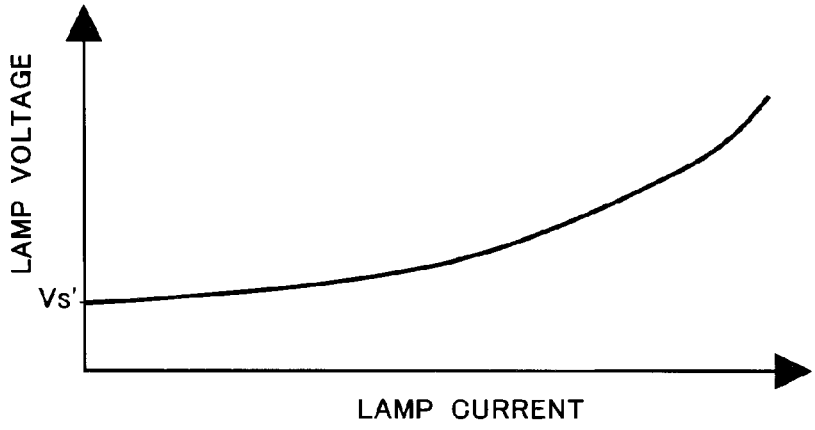
FIG. 18 is a diagram showing the V-I characteristic of the external-electrode fluorescent lamp shown in FIG. 17.
Figure 19:
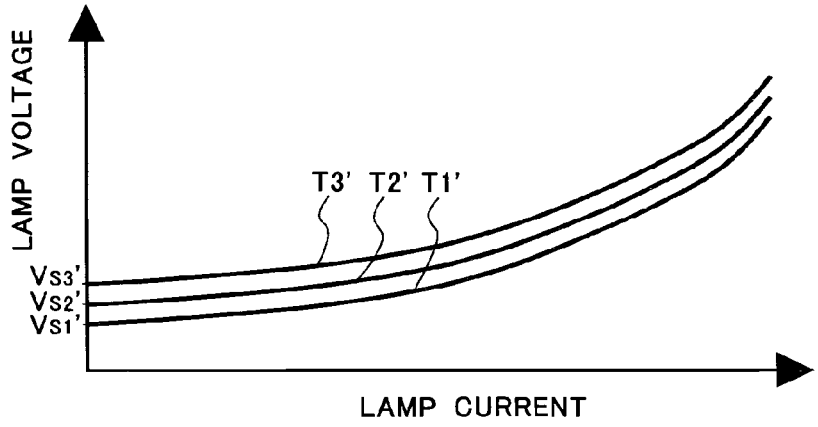
FIG. 19 is a diagram showing the V-I characteristics of a plurality of external-electrode fluorescent lamps.

In the cold-cathode lamp 17 structured as shown in FIG. 1 (hereinafter the "cold-cathode lamp 17"), a capacitor is formed by the external electrode 4 and the counter electrode 10 of the cold-cathode lamp 17, and another capacitor is formed by the external electrode 5 and the counter electrode 11 of the cold-cathode lamp 17. Thus, in terms of its equivalent circuit, the cold-cathode lamp 17 acts as a serial circuit including a resistor whose resistance decreases nonlinearly as the current through it increases and capacitors connected one to each terminal of the resistor, exhibiting, like the cold-cathode lamp shown in FIG. 17, a nonlinear positive impedance characteristic. Thus, when a plurality of cold-cathode lamps 17 are driven in parallel, they can all be lit. Moreover, in the cold-cathode lamp 17, since the internal and external electrodes are connected directly together, no additional parasitic capacitor or the like, as would be formed between harnesses (also called leads) and the electrically conductive casing of the illumination unit, appears between the resistor and the capacitor in the equivalent circuit. This makes it easy to suppress variations in lamp current among different cold-cathode lamps 17.

Moreover, in the cold-cathode lamp 17, charged particles do not collide with the portion of the inner wall surface of the glass tube facing away from the external electrodes, and thus there is no risk of pinholes being formed in the glass tube as in an external-electrode fluorescent lamp. In the cold-cathode lamp 17, charged particles do collide with and thereby wear (sputter) off the internal electrode, but, since the internal electrode is at an equal potential all over, charged particles reach, as on a lightning rod, a portion of the internal electrode near the discharge region on it, wearing it off there. As wear progresses, the portion of the internal electrode near the discharge region moves, preventing concentration of wear as in the external-electrode fluorescent lamp shown in FIG. 17. Thus the physical size of the internal electrode determines the operating life of the lamp.

Furthermore, in the cold-cathode lamp 17, a capacitor is formed by the external electrode 4 and the counter electrode 10 of the cold-cathode lamp 17, another capacitor is formed by the external electrode 5 and the counter electrode 11 of the cold-cathode lamp 17, and the counter electrodes 10 and 11 remain in fixed positions relative to the external electrodes 4 and 5. This stabilizes the capacitor formed by the external electrode 4 and the counter electrode 10 of the cold-cathode lamp 17 and the capacitor formed by the external electrode 5 and the counter electrode 11 of the cold-cathode lamp 17.

Figure 20:
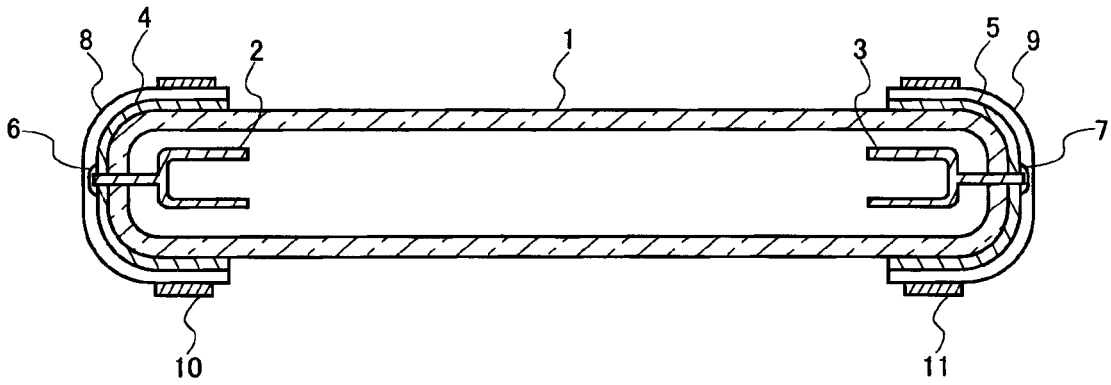
FIG. 20 is a diagram showing a schematic sectional view of a cold-cathode lamp having counter electrodes shaped differently from a cold-cathode lamp according to preferred embodiments of the present invention.

Now we will consider a cold-cathode lamp having counter electrodes 10 and 11 shaped differently from the cold-cathode lamp 17. A schematic sectional view of a cold-cathode lamp having counter electrodes 10 and 11 shaped differently from the cold-cathode lamp 17 is shown in FIG. 20. In FIG. 20, elements that find their counterparts in FIG. 1 are identified by common reference numerals and their detailed description will not be repeated.

In the cold-cathode lamp shown in FIG. 20, the lines of electric force produced by the electric charge on the external electrode 4 and the counter electrode 10 include not only those that rectilinearly connect the external electrode 4 and the counter electrode 10 but also those that take roundabout paths to reach the edge of the counter electrode 10. As a result, depending on the conditions of the voltage applied, the air layer near the edge of the counter electrode 10 may succumb to dielectric breakdown, causing corona discharge to occur near the edge of the counter electrode 10. If corona discharge occurs near the edge of the counter electrode 10, it may damage with heat the counter electrode 10 and the insulating layer 8, and may produce ozone, leading to poor reliability of the cold-cathode lamp. Likewise, in the cold-cathode lamp shown in FIG. 20, corona discharge may occur near the edge of the counter electrode 11.

In contrast, in the cold-cathode lamp 17, the counter electrode 10 has a non-facing portion not facing the external electrode 4; the counter electrode 11 has a non-facing portion not facing the external electrode 5; the gap between the non-facing portion of the counter electrode 10 and the glass tube 1 is filled by a portion of the insulating layer 8; the gap between the non-facing portion of the counter electrode 11 and the glass tube 1 is filled by a portion of the insulating layer 9; the external electrode 4 does not have a non-facing portion not facing the counter electrode 10; and the external electrode 5 does not have a non-facing portion not facing the counter electrode 11. This structure suppresses the lines of electric force taking roundabout paths to reach the edge of the counter electrodes 10 and 11, and thereby suppresses corona discharge near the edge of the counter electrodes 10 and 11, leading to higher reliability.

Figure 3A:
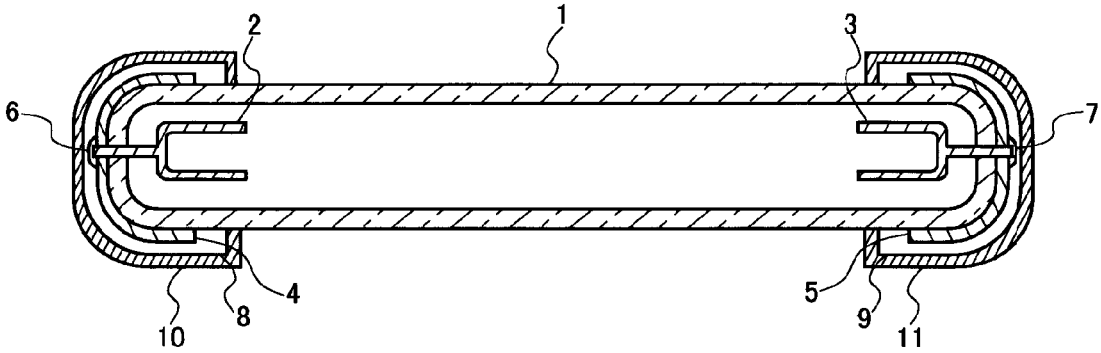
FIG. 3A is a diagram showing a modified example of a cold-cathode lamp according to a preferred embodiment of the present invention.
Figure 3B:
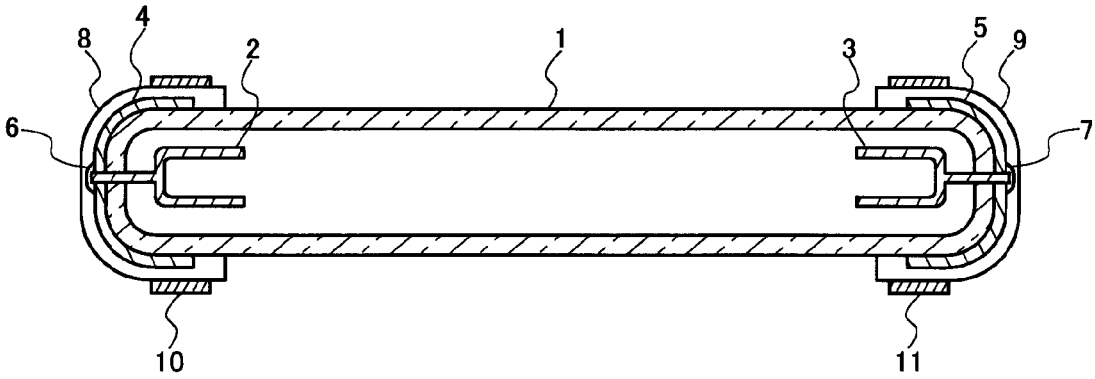
FIG. 3B is a diagram showing a modified example of a cold-cathode lamp according to a preferred embodiment of the present invention.
Figure 4A:
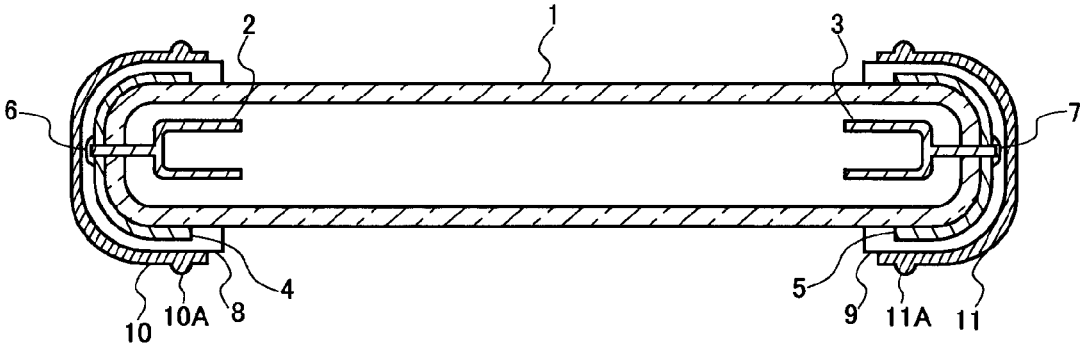
FIG. 4A is a diagram showing a modified example of a cold-cathode lamp according to a preferred embodiment of the present invention.
Figure 4B:
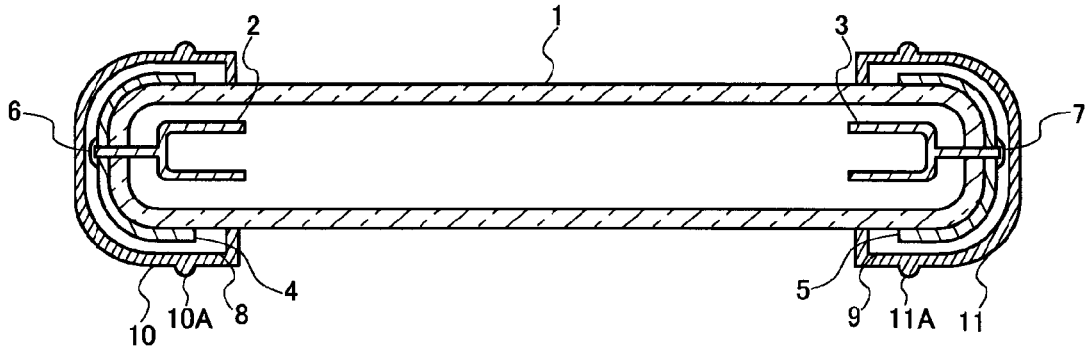
FIG. 4B is a diagram showing a modified example of a cold-cathode lamp according to a preferred embodiment of the present invention.
Figure 4C:
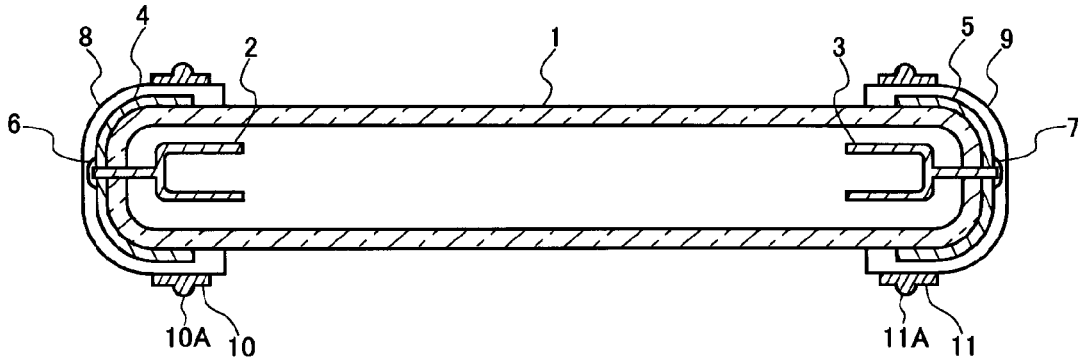
FIG. 4C is a diagram showing a modified example of a cold-cathode lamp according to a preferred embodiment of the present invention.

The shape of the counter electrodes 10 and 11 in the cold-cathode lamp 17 may be modified as in the cold-cathode lamp shown in FIG. 3A. In FIG. 3A, elements that find their counterparts in FIG. 1 are identified by common reference numerals and their detailed description will not be repeated. In the cold-cathode lamp shown in FIG. 3A, the counter electrodes 10 and 11 are shaped and arranged to completely cover the insulating layers 8 and 9 respectively. The shape of the counter electrodes 10 and 11 in the cold-cathode lamp 17 may be so modified as in the cold-cathode lamp shown in FIG. 3B. In FIG. 3B, elements that find their counterparts in FIG. 1 are identified by common reference numerals and their detailed description will not be repeated. In the cold-cathode lamp shown in FIG. 3B, the edge of the counter electrode 10 corresponds to the border between the non-facing portion (the portion that does not face the counter electrode 10) and the facing portion (the portion that faces the counter electrode 10)

of the external electrode 4, and the edge of the counter electrode 11 corresponds to the border between the non-facing portion (the portion that does not face the counter electrode 11) and the facing portion (the portion that faces the counter electrode 11) of the external electrode 5. As a result, lines of electric force may take roundabout paths to reach near the edge of the counter electrode 10 corresponding to the border between the non-facing portion and the facing portion of the external electrode 4 and the edge of the counter electrode 11 corresponding to the border between the non-facing portion and the facing portion of the external electrode 5, causing corona discharge. Thus the cold-cathode lamp shown in FIG. 3B is less reliable than the cold-cathode lamp shown in FIG. 1. Even then, in the cold-cathode lamp shown in FIG. 3B, corona discharge does not occur near the non-facing portions of the counter electrodes 10 and 11, resulting in far higher reliability than the cold-cathode lamp shown in FIG. 20.

The counter electrodes 10 and 11 of the cold-cathode lamp 17 simply need to be electrically connected to the holding members 14. Preferably, to ensure electrical connection between the counter electrodes 10 and 11 of the cold-cathode lamp 17 and the holding members 14, ring-shaped projections 10A and 11A may be provided on the counter electrodes 10 and 11 respectively so that, in the actually mounted state, the projections 10A and 11A make contact with the corresponding holding members 14.

Figure 5:
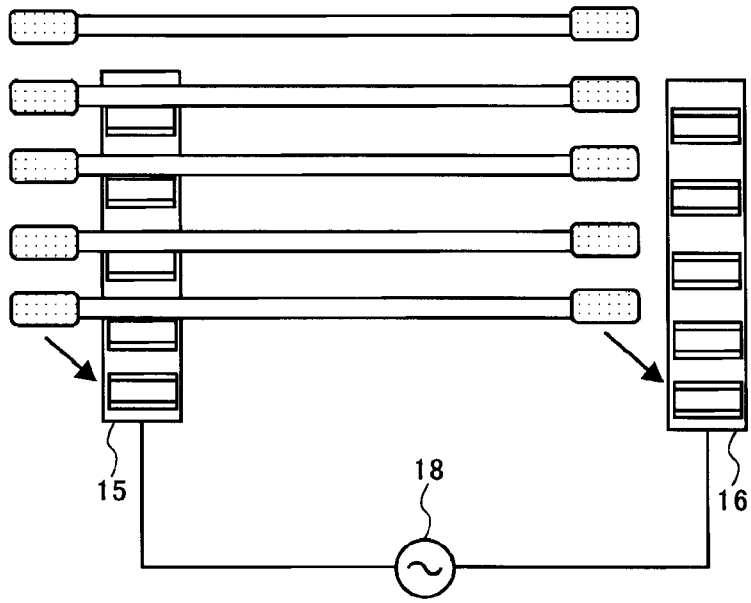
FIG. 5 is a diagram showing an example of arrangement of a power supply in a display illumination device according to a preferred embodiment of the present invention.
Figure 6:
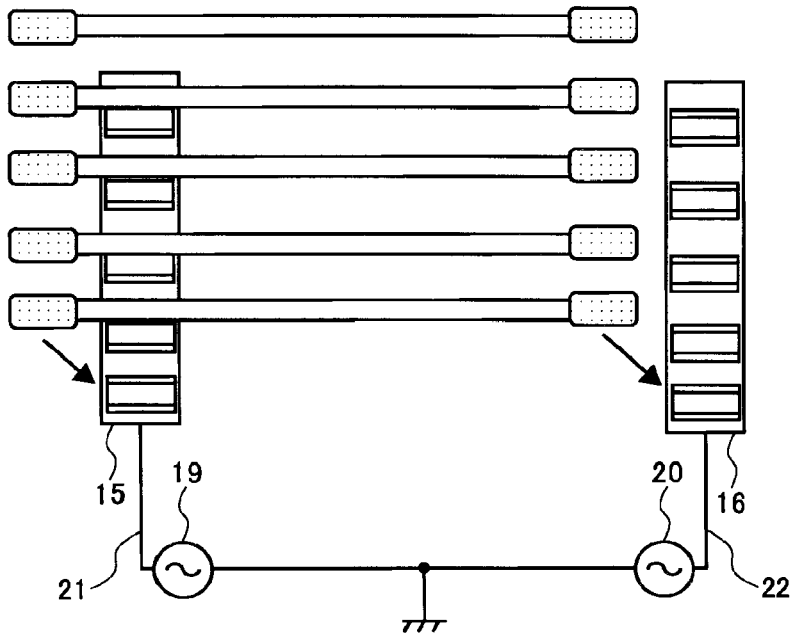
FIG. 6 is a diagram showing an example of arrangement of a power supply in a display illumination device according to a preferred embodiment of the present invention.

Next, examples of arrangement of a power supply in a display illumination device according to a preferred embodiment of the present invention will be described. In the example of power supply arrangement shown in FIG. 5, the holding members provided in the front left-edge portion 15 of the illumination unit are connected together to one end of a power supply 18. Likewise, the holding members provided in the front right-edge portion 16 of the illumination unit are connected together to the other end of the power supply 18. The power supply 18 is disposed on the rear surface of the illumination unit, and outputs an alternating-current voltage of several tens of kHz. In the example of power supply arrangement shown in FIG. 6, the holding members provided in the front left-edge portion 15 of the illumination unit are connected together to one end of a power supply 19. On the other hand, the holding members provided in the front right-edge portion 16 of the illumination unit are connected together to one end of another power supply 20. The other end of the power supply 19 and the other end of the power supply 20 are grounded. The power supplies 19 and 20 are both disposed on the rear surface of the illumination unit, and each output an alternating-current voltage of several tens of kHz. The example of power supply arrangement shown in FIG. 6 requires shorter run lengths of the high-voltage lines 21 and 22 for feeding the high voltage, contributing to stabilization of the lamp current and reduction of power loss.

In a display illumination device according to a preferred embodiment of the present invention, from the perspective of reducing the number of power supplies needed, it is preferable that all its cold-cathode lamps be driven in parallel by a single power supply. Depending on the capacity of the power supply and the number of cold-cathode lamps, however, it is also possible, instead of driving all the cold-cathode lamps in parallel by a single power supply, to divide the cold-cathode lamps into a plurality of groups and provide as many power supplies, each driving the cold-cathode lamps within a group in parallel.

With respect to cold-cathode lamps electrically connected in parallel, the phase of the voltage fed to their internal electrodes at one side and the phase of the voltage fed to their internal electrodes at the other side may be made approximately 180 degrees out of phase with, so as to be inverted with respect to, each other. This structure makes laterally symmetric the brightness slope attributable to the leak current through a conductor (for example, the metal casing of the display illumination device) located near the power lines for parallel connection, contributing to enhanced illumination quality. Moreover, this structure, when the display illumination device described above is incorporated in a display device, makes practically zero the voltage that affects the display device (for example, the display device of a liquid crystal display panel) located near the power lines for parallel connection, making it possible to cancel the noise in the display device originating from the display illumination device.

Figure 7:
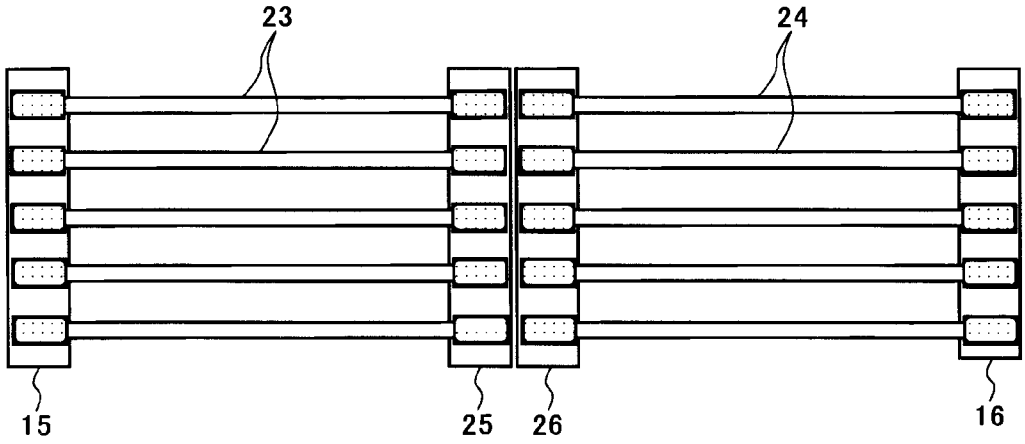
FIG. 7 is a diagram showing an example of arrangement of cold-cathode lamps and holding members in a display illumination device according to a preferred embodiment of the present invention.
Figure 8:
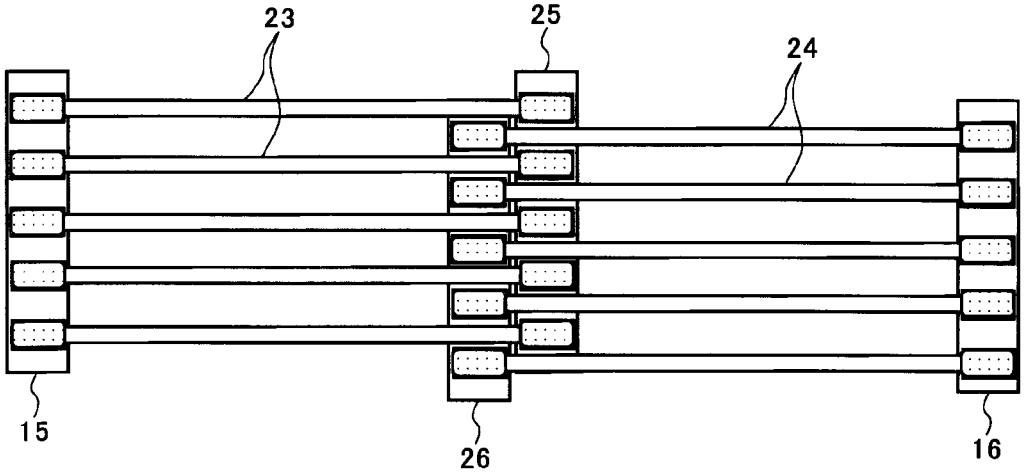
FIG. 8 is a diagram showing an example of arrangement of cold-cathode lamps and holding members in a display illumination device according to a preferred embodiment of the present invention.

In a case where a display illumination device according to a preferred embodiment of the present invention is applied to a display device with a display screen size over "37V", to hold the discharge start voltage of cold-cathode lamps low, it is preferable that, in the display illumination device according to a preferred embodiment of the present invention, the cold-cathode lamps and the holding members be arranged, for example, as shown in FIG. 7 or 8.

In the example of cold-cathode lamp/holding member arrangement shown in FIG. 7, the front left-end portions of front left-side cold-cathode lamps 23 are pinched in holding members provided in a front left-edge portion 15; the front right-end portions of the front left-side cold-cathode lamps 23 are pinched in holding members provided in a first central portion 25; the front right-end portions of front right-side cold-cathode lamps 24 are pinched in holding members provided in a front right-edge portion 16; the front left-end portions of the front right-side cold-cathode lamps 24 are pinched in holding members provided in a second central portion 26.

In the example of cold-cathode lamp/holding member arrangement shown in FIG. 8, the front left-end portions of front left-side cold-cathode lamps 23 are pinched in holding members provided in a front left-edge portion 15; the front right-end portions of the front left-side cold-cathode lamps 23 are pinched in holding members provided in a first central portion 25; the front right-end portions of front right-side cold-cathode lamps 24 are pinched in holding members provided in a front right-edge portion 16; the front left-end portions of the front right-side cold-cathode lamps 24 are pinched in holding members provided in a second central portion 26. In addition, the glow region of the front right-side cold-cathode lamps 24 covers the first central portion 25, and the glow region of the front left-side cold-cathode lamps 23 covers the second central portion 26. As compared with the example of cold-cathode lamp/holding member arrangement shown in FIG. 7, the example of cold-cathode lamp/holding member arrangement shown in FIG. 8 suffers less drop of brightness in the first and second central portions 25 and 26.

In the examples of cold-cathode lamp/holding member arrangement shown in FIGS. 7 and 8, it is preferable that the surface layer of the front right-end portions (non-growing regions) of the front left-side cold-cathode lamps 23 and the surface layer of the front left-end parts (non-growing regions) of the front right-side cold-cathode lamps 24 be formed of a material with high reflectance. Moreover, a white material there helps alleviate uneven brightness in the first and second central portions 25 and 26. Thus, it is further preferable to use a white material with high reflectance.

Next, examples of arrangement of a power supply in the examples of cold-cathode lamp/holding member arrangement shown in FIGS. 7 and 8 will be described.

Figure 9:
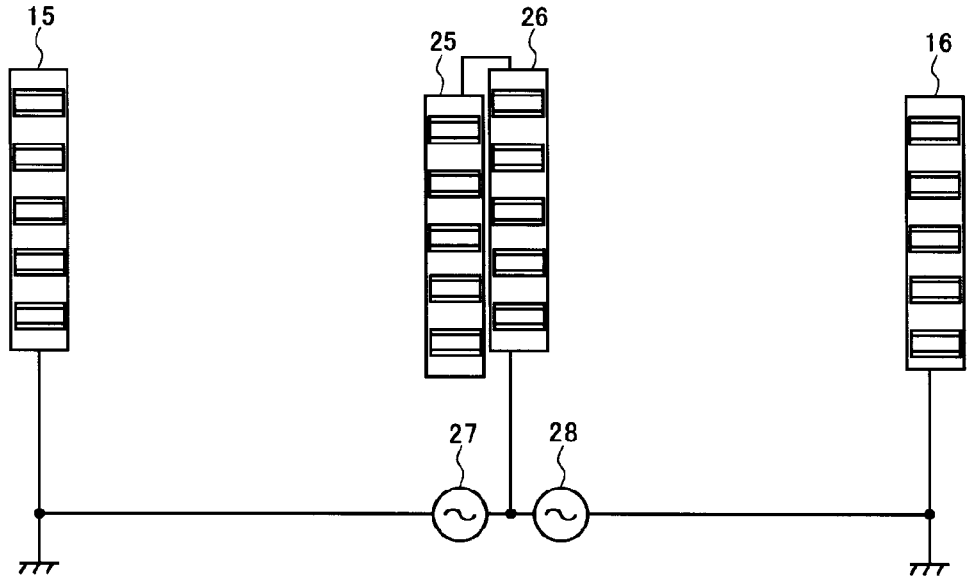
FIG. 9 is a diagram showing an example of arrangement of power supplies in the arrangements of cold-cathode lamps and holding members shown in FIGS. 7 and 8.

In the example of power supply arrangement shown in FIG. 9, the holding members provided in the front left-edge portion 15 of the illumination unit are connected together to one end of a power supply 27 and also to ground; the holding members provided in the front right-edge portion 16 of the illumination unit are connected together to one end of another power supply 28 and also to ground; the holding members provided in the first central portion 25 of the illumination unit and the holding members provided in the second central portion 26 of the illumination unit are connected together to the other end of the power supply 27 and also to the other end of the power supply 28. The power supplies 27 and 28 are both disposed on the rear surface of the illumination unit, and each output an alternating-current voltage of several tens of kHz; the power supplies 27 and 28 output, at their respective other ends, voltages of the same phase.

Figure 10:
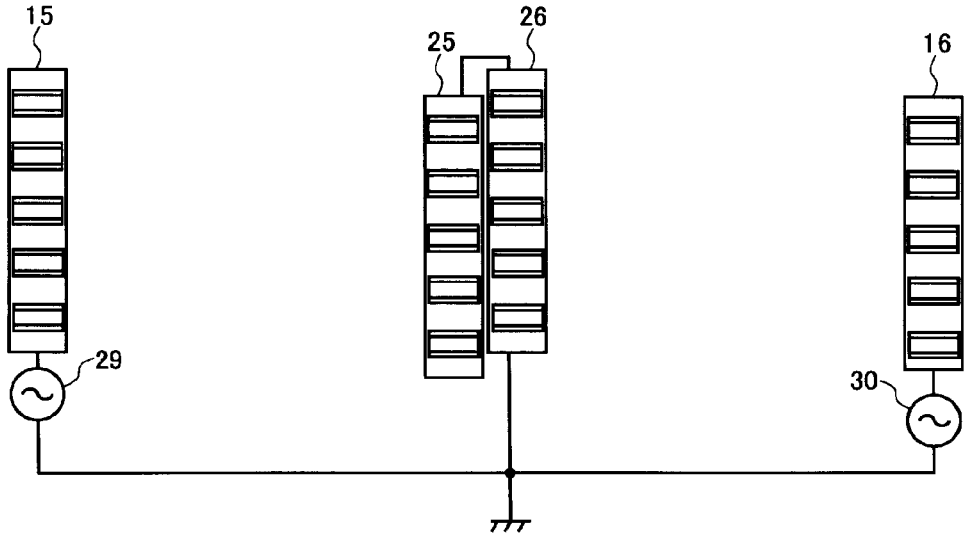
FIG. 10 is a diagram showing an example of arrangement of power supplies in the arrangements of cold-cathode lamps and holding members shown in FIGS. 7 and 8.

In the example of power supply arrangement shown in FIG. 10, the holding members provided in the front left-edge portion 15 of the illumination unit are connected together to one end of a power supply 29; the holding members provided in the front right-edge part 16 of the illumination unit are connected together to one end of another power supply 30; the holding members provided in the first central portion 25 of the illumination unit and the holding members provided in the second central portion 26 of the illumination unit are connected together to the other end of the power supply 29, also to the other end of the power supply 30, and also to ground. The power supplies 29 and 30 are both disposed on the rear surface of the illumination unit, and each output an alternating-current voltage of several tens of kHz; the power supplies 29 and 30 output, at their respective one ends, voltages of the same phase or of mutually inverted phases.

Figure 11:
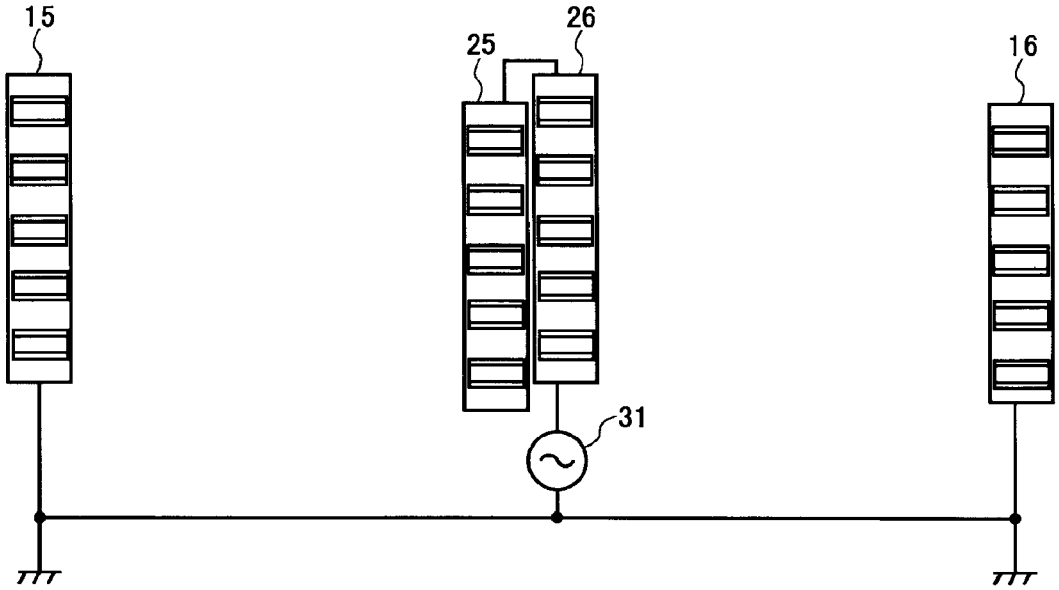
FIG. 11 is a diagram showing an example of arrangement of a power supply in the arrangements of cold-cathode lamps and holding members shown in FIGS. 7 and 8.
Figure 12A:
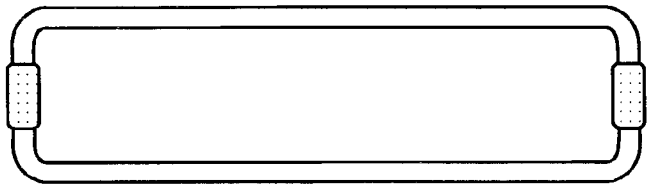
FIG. 12A is a diagram showing a modified example of a cold-cathode lamp according to a preferred embodiment of the present invention.
Figure 12B:
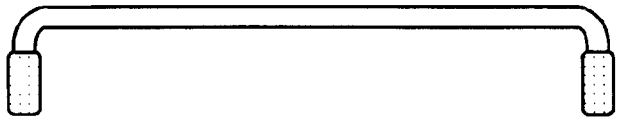
FIG. 12B is a diagram showing a modified example of a cold-cathode lamp according to a preferred embodiment of the present invention.
Figure 12C:
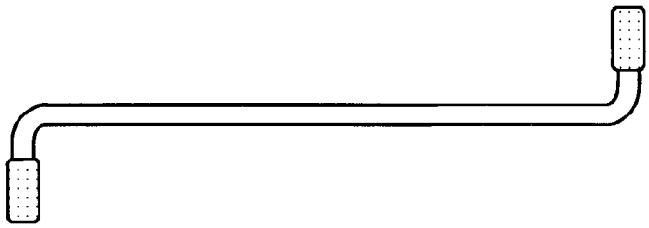
FIG. 12C is a diagram showing a modified example of a cold-cathode lamp according to a preferred embodiment of the present invention.
Figure 12D:
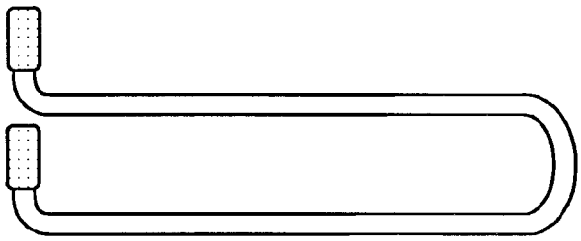
FIG. 12D is a diagram showing a modified example of a cold-cathode lamp according to a preferred embodiment of the present invention.
Figure 12E:
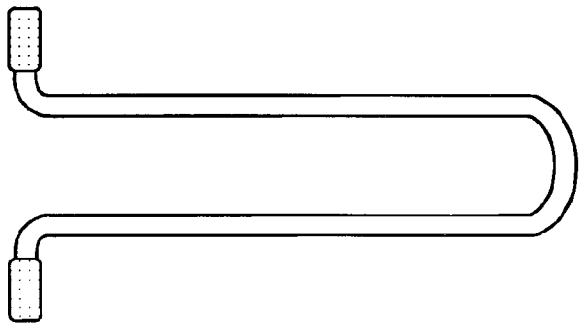
FIG. 12E is a diagram showing a modified example of a cold-cathode lamp according to a preferred embodiment of the present invention.
Figure 12F:
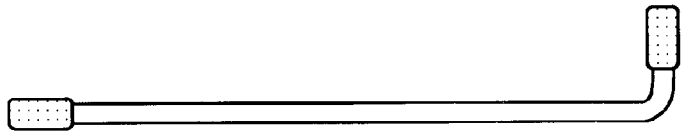
FIG. 12F is a diagram showing a modified example of a cold-cathode lamp according to a preferred embodiment of the present invention.

In the example of power supply arrangement shown in FIG. 11, the holding members provided in the front left-edge portion 15 of the illumination unit are connected together to one end of a power supply 31 and also to ground; the holding members provided in the front right-edge portion 16 of the illumination unit are connected together to the same end of the power supply 31 and also to ground; the holding members provided in the first central portion 25 of the illumination unit and the holding members provided in the second central portion 26 of the illumination unit are connected together to the other end of the power supply 31. The power supply 31 is disposed on the rear surface of the illumination unit, and outputs an alternating-current voltage of several tens of kHz.

The examples of power supply arrangement shown in FIGS. 9 to 11 all require shorter run lengths of the high-voltage lines for feeding the high voltage, contributing to stabilization of the lamp current and reduction of power loss.

As shown in FIGS. 12A to 12F, in a cold-cathode lamp according to a preferred embodiment of the present invention, part or all of the axis of its external electrode portion (the portion where the external electrode is formed on the glass tube) may be so bent as to be perpendicular or substantially perpendicular to the axis of its glow portion aligned in the main arrangement direction. With this structure, in a cold-cathode lamp according to a preferred embodiment of the present invention, with a view to increasing the capacitance of the capacitor including the counter electrode and the external electrode, the area of these can be increased without an undue increase in the width of the frame portion of a display illumination device.

Figure 13A:
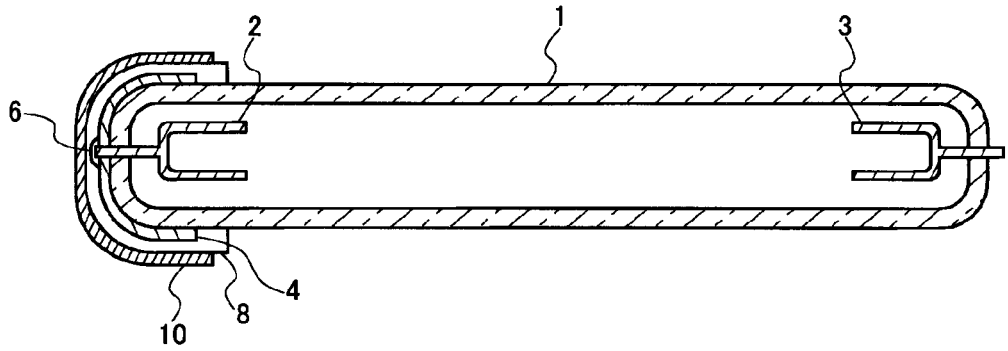
FIG. 13A is a diagram showing a modified example of a cold-cathode lamp according to a preferred embodiment of the present invention.
Figure 13B:
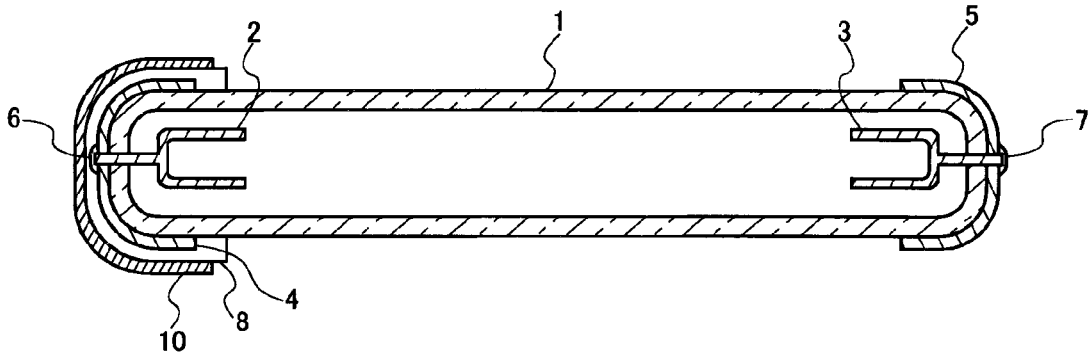
FIG. 13B is a diagram showing a modified example of a cold-cathode lamp according to a preferred embodiment of the present invention.

The preferred embodiments described above deal with cases where a cold-cathode lamp according to the present invention is preferably provided with two external electrodes. Providing only one external electrode, however, suffices to obtain a nonlinear positive impedance characteristic. Thus, a cold-cathode lamp according to a preferred embodiment of the present invention may be provided with only one external electrode. For example, modifying the cold-cathode lamp according to a preferred embodiment of the present invention shown in FIG. 1 to have only one external electrode leads to a structure as shown in FIG. 13A. With the structure shown in FIG. 13A, however, the internal electrodes 3 side end portion of the lamp needs to be connected to a power supply via a harness (also called a lead) and a connector, and this makes the fitting and removal of the cold-cathode lamp troublesome. The preferred embodiments described above deal with cases where a cold-cathode lamp according to the present invention is preferably provided with two insulating layers. Providing only one insulating layer, however, suffices to obtain a non-linear positive impedance characteristic. Thus, a cold-cathode lamp according to a preferred embodiment of the present invention may be provided with only one insulating layer. For example, modifying the cold-cathode lamp according to a preferred embodiment of the present invention shown in FIG. 1 to have only one insulating layer leads to a structure as shown in FIG. 13B. With the structure shown in FIG. 13B, the internal electrodes 3 side end portion of the lamp can be pinched in, by the resilience of, a holding member formed of a resilient metal material (for example, spring steel). This makes the fitting and removal of the cold-cathode lamp easy.

A display device according to another preferred embodiment of the present invention includes a display illumination device according to various preferred embodiments of the present invention as described above and a display panel. Among specific examples of display devices according to preferred embodiments of the present invention are transmissive liquid crystal display devices including as a backlight a display illumination device and having, on its front surface, a liquid crystal display panel.

Cold-cathode lamps according to various preferred embodiments of the present invention can be used as illumination sources provided in display illumination devices and as illumination sources provided in other various devices.

While preferred embodiments of the present invention have been described above, it is to be understood that variations and modifications will be apparent to those skilled in the art without departing the scope and spirit of the present invention. The scope of the present invention, therefore, is to be determined solely by the following claims.

The invention claimed is:

1. A cold-cathode lamp that is supplied with electric power via first and second conductive members provided externally, comprising:

an insulating tube made of a light-transmitting, electrically insulating material;

a first internal electrode disposed inside the insulating tube;

a second internal electrode disposed inside the insulating tube;

a first external electrode disposed outside the insulating tube and connected to the first internal electrode so as to be at a same potential as the first internal electrode;

a first insulating member;

a first counter electrode disposed to face the first external electrode across the first insulating member; wherein the first counter electrode has a non-facing portion not facing the first external electrode;

a gap between the non-facing portion of the first counter electrode and the insulating tube is filled by part of the first insulating member, and when the cold-cathode lamp is mounted for actual use, the first conductive member and the first counter electrode are electrically connected together.

2. The cold-cathode lamp according to claim 1, further comprising:

a second external electrode disposed outside the insulating tube and connected to the second internal electrode so as to be at a same potential as the second internal electrode;

a second insulating member;

a second counter electrode disposed to face the second external electrode across the second insulating member; wherein the second counter electrode has a non-facing portion not facing the second external electrode;

a gap between the non-facing portion of the second counter electrode and the insulating tube is filled by part of the second insulating member, and when the cold-cathode lamp is mounted for actual use, the second conductive member and the second counter electrode are electrically connected together.

3. The cold-cathode lamp according to claim 1, wherein the first external electrode does not have a non-facing portion not facing the first counter electrode.

4. The cold-cathode lamp according to claim 2, wherein the first external electrode does not have a non-facing portion not facing the first counter electrode, and the second external electrode does not have a non-facing portion not facing the second counter electrode.

5. The cold-cathode lamp according to claim 1, wherein the first counter electrode has a projection, and when the cold-cathode lamp is mounted for actual use, the first conductive member and the projection of the first counter electrode make contact with each other.

6. The cold-cathode lamp according to claim 2, wherein the first counter electrode has a projection, when the cold-cathode lamp is mounted for actual use, the first conductive member and the projection of the first counter electrode make contact with each other, the second counter electrode has a projection, and when the cold-cathode lamp is mounted for actual use, the second conductive member and the projection of the second counter electrode make contact with each other.

7. A display illumination device, comprising:

the cold-cathode lamp according to claim 1;

first and second conductive members; and a power supply supplying electric power to the cold-cathode lamp via the first and second conductive members.

8. The display illumination device according to claim 7, wherein the cold-cathode lamp comprises a plurality of like cold-cathode lamps, and all or a portion of the cold-cathode lamps are electrically connected in parallel.

9. The display illumination device according to claim 8, wherein among the cold-cathode lamps electrically connected in parallel, a phase of a voltage fed to the first internal electrode and a phase of a voltage fed to the second internal electrode are substantially 180 degrees out of phase with, so as to be inverted with respect to, each other.

10. A display device comprising the display illumination device according to claim 7.

* * * * *